United States Patent [19]

Brochman

[11] Patent Number: 4,564,121

[45] Date of Patent: Jan. 14, 1986

[54] TAPE CLOSURE FOR A CAN END

[75] Inventor: Wilfred R. Brochman, Oakdale, Minn.

[73] Assignee: Minnesota Mining and Manufacturing Company, St. Paul, Minn.

[21] Appl. No.: 561,462

[22] Filed: Dec. 14, 1983

Related U.S. Application Data

[63] Continuation-in-part of Ser. No. 458,564, Jan. 7, 1983, abandoned.

[51] Int. Cl.[4] ..... B65D 41/00

[52] U.S. Cl. ..... 220/359

[58] Field of Search ..... 220/359

[56] References Cited

U.S. PATENT DOCUMENTS

| | | | |
|---|---|---|---|
| 3,052,246 | 9/1962 | Beard | 206/5.1 |
| 3,312,368 | 4/1967 | Reynolds et al. | 220/359 |
| 3,338,462 | 8/1967 | Reynolds et al. | 220/359 |
| 3,343,657 | 9/1967 | Speshyock | 206/5.1 |
| 3,367,481 | 2/1968 | Tanaka | 206/5.1 |
| 3,378,020 | 4/1968 | Grabiel | 206/5.1 |
| 3,391,847 | 7/1968 | Christine et al. | 220/359 |
| 3,524,455 | 8/1970 | Hoogesteger et al. | 206/5.1 |
| 3,655,503 | 4/1972 | Stanley et al. | 161/165 |
| 3,770,113 | 11/1973 | Thomas | 206/5.1 |
| 3,990,579 | 11/1976 | Manning | 206/5.1 |
| 3,997,049 | 12/1976 | Sherman | 206/5.1 |
| 4,029,033 | 6/1977 | Kerwin et al. | 220/359 |
| 4,034,132 | 7/1977 | Manuel | 220/359 |
| 4,163,506 | 8/1979 | Patterson | 220/359 |
| 4,167,234 | 9/1979 | Gordon et al. | 220/359 |
| 4,167,283 | 9/1979 | Feldman | 294/1.2 |
| 4,210,255 | 7/1980 | Pan | 220/359 |
| 4,280,653 | 7/1981 | Elias | 220/359 |
| 4,332,318 | 6/1982 | Feldman | 206/5.1 |

FOREIGN PATENT DOCUMENTS

| | | | |
|---|---|---|---|
| 2301538 | 7/1974 | Fed. Rep. of Germany | 294/1.2 |
| 1197161 | of 1904 | United Kingdom . | |

*Primary Examiner*—Joseph Man-Fu Moy

*Attorney, Agent, or Firm*—Donald M. Sell; James A. Smith; John C. Barnes

[57] ABSTRACT

A tape closure which is adhesively adhered about a pour opening on the exterior surface of a can end having a protective polymeric layer over the metallic can end which is adhered to the tape adhesive with a bond greater than the bond between the layer and the supporting surface therefor affording removal of the layer upon breaking the coating and delaminating the same from the support surface upon removal of the tape.

7 Claims, 8 Drawing Figures

TAPE CLOSURE FOR A CAN END

CROSS-REFERENCE TO RELATED APPLICATIONS

This is a continuation-in-part application of application Ser. No. 458,564 filed Jan. 7, 1983 abandoned.

BACKGROUND OF THE INVENTION

Field of the Invention

This invention relates to a container end assembly and in one aspect to an improved container end construction for use on beverage containers and having an opening in said end covered by a length of removable tape. More particularly, this invention provides an improved tape closure for container ends which permits the clean opening of the container utilizing a tape closure.

The present invention provides an improved tape closure and has as an object thereof the leaving of a clean area surrounding the pour hole upon removal of the tape. This would be true of tape closures for container ends utilizing simply an exterior tape or a two-tape system, including an exterior tape and an interior sheet material situated circumjacent (over and surrounding) a preformed opening (i.e. a pour opening) in a container end portion.

The present invention provides a tape closure which when opened sufficiently to obtain access to the pour hole is not self-sealing and thus offers resistance to tampering which would not be possible of detection.

The present invention provides a tape closure for container ends which will withstand the internal pressure of carbonated beverages or other beverages where an internal pressure is developed.

The present invention provides an improved tape closure which is suitable for use with pressurized containers but which is easily removable as the force necessary for peeling the closure from the can end is relatively small compared to the force necessary to open score lines in the metal defining an opening. The present invention also reduces the amount of force necessary in a two-tape system for removing a tape closure.

SUMMARY OF THE PRESENT INVENTION

The present invention provides a container end assembly including a metallic can end of metal, i.e., tin plate or tin-free steel, aluminum or a composite of plastic and metal, formed with a pour opening, the exterior surface of the can end is coated with a layer of protective material, i.e. an enamel, and a tape is applied and adhered to the protective layer over the pour opening. The tape is provided with a heat activatable thermoplastic adhesive to secure the tape backing to the protective layer or coating on the can end. The adhesive is preferably bonded to the protective layer in a pattern to provide at one end of the pour opening a narrowing of the adhesive bond across the width of the tape to afford an initial reduced area for force concentration for the easy fracture of the protective layer to delaminate the protective layer in the area of the adhesive bond of the tape to separate the protective layer from the can end utilizing the high shear strength of the bonds between the tape and the protective layer and the protective layer and the can to withstand the pressure but relying on the weak peel strength of the bond between the protective layer and the can end to afford an easy open tape closure. In a two-tape system an interior sheet material is adhered to the inner surface of the can end circumjacent the pour opening and, in the area of the pour opening, the external tape is bonded by the adhesive to the interior sheet material to afford tearing of the interior sheet material at the edges of the pour opening as the exterior tape is peeled from the can end.

In the preferred embodiment the can end is formed from metal sheet stock, e.g., tin-free steel (TFS), coated with a first exterior layer for the can end which may be a lacquer or an enamel, and a second protective layer which may be a lacquer, enamel or a vinyl coating, is placed over the first layer, each of which is cured after being coated by heating to afford a releasable bond between the two layers. The exterior tape is then bonded to the second layer by an adhesive which bonds the two more firmly than the second layer bonds to the first. When the tape is removed to open the can, the bond between the two layers is ruptured and the second layer is peeled from the can end with the tape, exposing a clean pour opening.

BRIEF DESCRIPTION OF THE DRAWING

The present invention will be explained in greater detail hereinafter with reference to the accompanying drawing wherein.

DESCRIPTION OF THE PREFERRED EMBODIMENT

Figure 1:
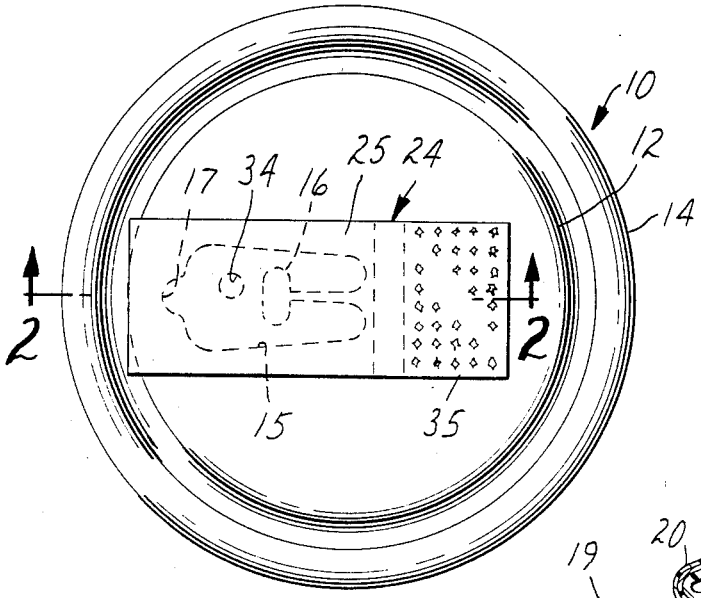
FIG. 1 is a plan view of a container end assembly including a tape closure illustrating the present invention.
Figure 4:
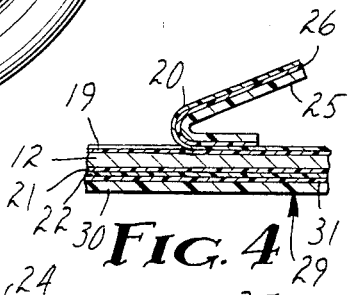
FIG. 4 is a detail fragmentary vertical sectional view through the closure and can end of the present invention with the closure in the open position.
Figure 2:
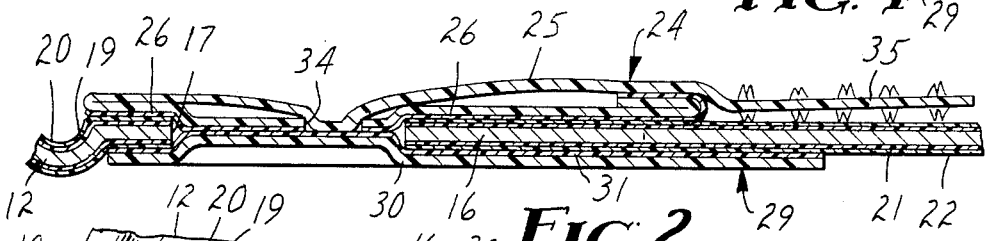
FIG. 2 is a vertical sectional view taken along the line 2—2 of FIG. 1.

Referring now to the drawing there is illustrated a preferred embodiment of a container end assembly according to the present invention and generally designated by the reference numeral 10.

The present invention can be utilized with can ends for containers of material which will not be pressurized and in such applications only an exterior tape adhered to the container end circumjacent the pour opening would be utilized. The illustrated assembly includes a tape closure utilizing an exterior tape and an interior tape which is suitable for all applications.

The container end assembly 10 comprises a container or can end 12 formed of a flexible metallic sheet material or metal which takes a permanent set when folded and has a circular flange 14 about the periphery for attachment to an end of a cylindrical container. The can end 12 has a generally U-shape cut 15 defining three sides of an opening in the container end forming the pour opening 15. On the fourth side of the pour opening 15, a tongue 16 is formed which extends from the side into the pour opening to hold the tape, upon opening of the closure, in a position away from the pour opening and to restrict the possibility of entirely separating the tape closure from the can end upon opening the same such that the closure does not become separated from the can and not properly deposited or disposed of by the person opening the container. The tongue-like portion 16 is described and claimed in U.S. Pat. No. 4,108,330, assigned to the assignee of this invention.

Additionally, as taught in U.S. Pat. No. 3,990,603, assigned to the assignee of this application, the pour opening 15 preferably includes a relatively narrow arcuate portion 17 extending toward the flange 14 of the can end 12. The portion 17 will be the first part of the illustrated pour opening uncovered as the tape is being peeled from the can. When this occurs, the portion 17 permits a small area of the interior tape to be drawn against the edge of the opening 15 and it will begin to tear along the edges of the portion 17 and progress along the remaining portions of the three sides of the opening 15 to neatly tear the interior sheet material covering the pour opening 15.

The can end 12 may be formed of a metal which is subject to corrosion and thus is provided with a protective layer to restrict corrosion and maintain its appearance. In this respect the can end 12 is provided with a first exterior coating defining a first layer 19 which is applied to the material forming the can end and is cured. A second coating or layer 20 is then applied to the layer 19 and is suitably cured to form a bond between the first layer 19 and the second layer 20. In current practice in the industry a first interior coating 21 is applied to the interior surface of the can end and a top coating 22 is applied over the coating 21 in a similar manner by applying the first coating and curing the same and then applying the second coating 22 and curing the same. A single interior coating would be sufficient with a coating defining a layer having the protective properties and adhesion required while being ductile enough not to crack or fracture during the can end making and sealing operations.

An exterior tape 24 is adhered to the exterior surface of the can end 12 in a position circumjacent and completely covering the pour opening 15. The tape 24 comprises a backing 25 having coated on one surface thereof an adhesive 26 which adheres tightly to the backing 25 and in the presence of heat and pressure bonds the backing 25 securely to the exterior layer 20 of the can end. The adhesive 26 forms a bond to the external top layer 20, having greater shear and peel strength then the bond between the top layer 20 and a first layer 19. An adhesive bond is made to the can end 12 about the pour opening 15 and has a peripheral pattern such that at one end of the pour opening 15 adjacent the flange 14 the peripheral edges of the adhesive 26, where it is bonded to the layer 20, converge to a point 28. This pattern is such that the peeling force applied to the tape 24 is concentrated initially on a small area, as at the point 28, to afford the initial fracture of the outer second layer 20. Continued peeling of the tape removes the layer 20 bonded to the adhesive 26 from the layer 19.

The container end assembly 10 also includes an interior sheet material 29 comprising a thin transparent sheet material 30 having an adhesive layer 31 which material is firmly adhered to the inner surface of the can end circumjacent and completely covering the opening 15. Sheet 30 is adhesively secured to the interior top coat 22 and is adhesively secured to the opposed adjacent surface of the exterior tape 24 through the pour opening 15 and to the tongue 16. This interior sheet material 30 can serve to protect the edge of the can along the cut forming the pour opening 15 and the tongue 16 from the contents of the container.

In the example illustrated in the drawing it is also seen that an opening 34 is formed in the backing 25 and the adhesive 26 of the exterior tape in the area of the pour opening 15. Through this opening 34, the backing 25 may be pressed against the adhesive 31 of the interior sheet material 30 to seal the opening 34. The bond between the backing 25 and the adhesive 31 is sufficient such that upon lifting the exterior tape 24 by a free end or tab 35 the first thing to happen is a fracturing of the interior tape 30 in the area of the opening 34 to provide a small pressure relief aperture which will allow a safe and relatively quiet release of the pressure within the container without causing the contents to spray from the pour opening.

Figure 3:
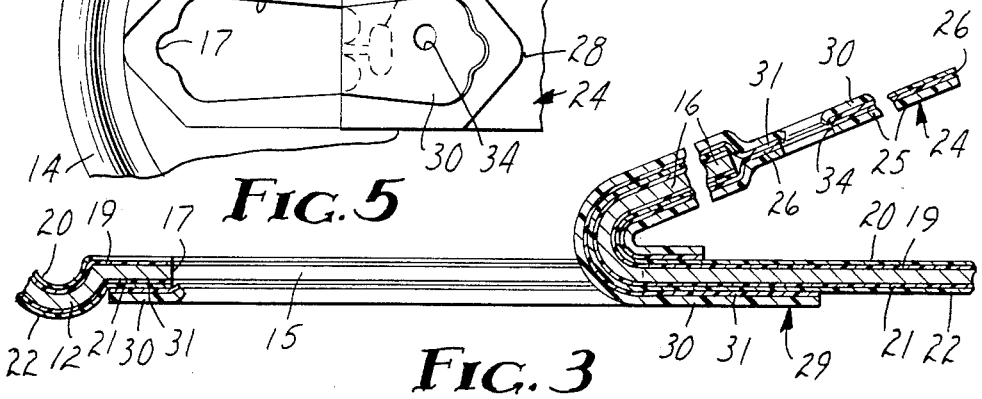
FIG. 3 is a second vertical sectional view corresponding to that of FIG. 2 showing the closure in the open position.

Upon lifting of the free end 35 of the exterior tape 24 the vent is opened at the hole 34 and then the continued application of pressure on the tape 24 will cause a fracture of the second exterior layer 20 at the area 28. Then the exterior layer 20 will be peeled with the exterior tape from the first coating 19 in the area of the adhesive bond to the layer 20 such that the tape may be easily removed from the exterior of the can end covering the pour opening. As the progressive peeling reaches the arcuate portion 17 of the pour opening the interior tape is fractured along the edge of the portion 17 and the bond between the adhesive 31 of the interior tape and the adhesive 26 of the exterior tape will cause the interior tape to continue to tear along the edges of the pour opening 15. The exterior tape 24 is removed progressively from the can end by a delamination between the exterior second layer 20 and the first layer 19 on the can end. As the opening of the container progresses the tongue 16 begins to fold and folds back across the container end 12. Since the tongue 16 is sandwiched between the interior and the exterior tapes and is adhered thereto through the coatings the tongue remains secured to the tapes and to the can end 22 at the edge of the pour opening but it is folded, and when folded, stays in its folded position to retain the tape in a position back from the pour opening as illustrated in FIGS. 3 and 5.

Figure 5:
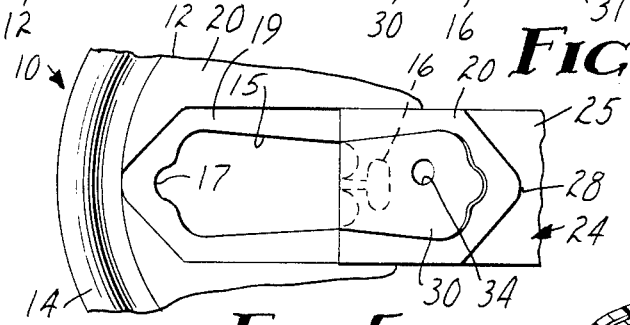
FIG. 5 is a fragmentary plan view of the container end with the closure in the open position.

FIG. 5 illustrates diagrammatically the fracture line of the exterior layer 20 and shows the exposed first exterior layer 19 and the separated and peeled portion of the exterior layer 20 remains adhered to the adhesive on the backing 25 of the exterior tape 24. The line of the fracture can be noticed by moving a finger nail from the pour opening across the can end surface normal to the direction of the peeling of the tape. Since the separated layer 20 will not self-adhere back to the layer 19 the closure tape 24 cannot be returned to its initial position and adhere to the can end about the opening 15.

Thus, the present invention provides a tape closure for a metal can end formed with a pour opening and coatings protecting it against corrosion and deterioration of the appearance of the can end in such a manner that the can end may be sealed during transportation and storage and easily opened by the user in a manner to afford a clean, adhesive-free, uncontaminated coating surrounding the pour opening from which the contents may be dispensed.

The following is an illustrative example of a container end assembly of the type described above.

A generally circular steel can end 12 of 0.33 mm (0.013 inch) thick single reduced tin-free steel was formed with a generally U-shaped cut 15 to form a pour opening and a tongue 16. The sheet steel forming the can end 12 was coated with an enamel, e.g. epoxy/-phenolic resin such as Mobil S-9200-001, available from Mobil Chemical Company of Pittsburgh, Pa., U.S.A. The layer 19 had a film weight of 14.0 mg per 25.8 square cm (4 square inches) and was baked at 204° C. (400° F.) for 10 minutes. Coated over the epoxy/-phenolic layer 19 was a second layer, e.g. a clear vinyl coating such as Mobil S-4134-025, available from Mobil Chemical Company. The layer 20 had a film weight of 18.0 mg. per 25.9 square cm (4 square inches) and was baked for 10 minutes at a temperature of 179.4° C. (355° F.).

To this exterior coating 20 was applied the exterior tape 24 comprising a polycarbonate film backing (for example "Merlon 700" resin from Mobay Corporation of Pittsburgh, Pa.) having a thickness of about 5 mils (130 micrometers) and having a linear thermoplastic polyurethane adhesive, such as that designated "Texin 480F" (which is commercially available from Mobay Corporation) or "Estane 58277" (which is commercially available from B. F. Goodrich Company) coated thereon.

The exterior tape 24 was adhered to the exterior layer and can end by applying the tape circumjacent the pour opening 15 and adhering the same in the presence of heat at a temperature of between 162° to 218° C. (325° to 425° F.) under a pressure of 275790 to 620528 Pascals (40 to 90 psi).

The interior surface of the can end 12 is preferably coated with an enamel, e.g. epoxy/phenolic resin as was the exterior coat 19, and a second coating to form a second layer of e.g. a clear vinyl layer such as the layer 20 may also be applied. Alternatively a single layer may be applied to the interior surface of the sheet material which offers corrosion protection and adhesion to the sheet material while being ductile enough when cured to avoid fracture or cracking during the formation of the can end. An example is a dispersion vinyl coating such as Mobil S9434-037 (available from Mobil Chemical Company).

To this interior coating can be applied an interior sheet material 29 comprising a flexible transparent sheet material including a plastic film such as polyethylene terephthalate, polyvinylchloride (unplasticized), composite films comprising a layer of polyethyleneterephthalate and a layer of polyethylene terephthalate/polyethyleneisophthalate copolymer (with respective monomer ratios ranging from 60/40 to 80/20), and films derived from a graft copolymer comprising acrylonitrile/-methylmethacrylate copolymer grafted onto an acrylonitrile/butadiene copolymer backbone. A particularly useful graft copolymer is formed by graft polymerizing acrylonitrile (73–77 parts by wt.) and methylmethacrylate (23–27 parts by wt.) in the presence of 8 to 10 parts by wt. of an acrylonitrile/butadiene copolymer (70% by wt. derived from butadiene).

The adhesive layer 31 on the interior sheet material 29 is preferably less than about 100 micrometers in thickness and is firmly anchored to the backing material. The adhesive must provide a bond of sufficient strength between the exterior film material 24 and the interior sheet material 29 such that when the exterior flexible film is stripped back, the interior sheet material is cleanly removed in the area of the pour opening. Suitable adhesives provide a means of attachment of the exterior flexible film to the interior sheet material which will stand a force of up to 3.9 kg per cm width (22 pounds per sq. in. width) of said exterior flexible film at temperatures from at least 2° to 38° C. (35° F. to 100° F.) without separation of the flexible film from the interior sheet material.

The specific adhesive 31 includes a thermoplastic polyurethane adhesive as described hereinabove.

In one embodiment, the interior sheet material 29 comprises a composite plastic film in which one layer thereof serves as the backing member and the other layer thereof serves as the adhesive. This particular composite film comprises a layer of polyethylene terephthalate (which serves as the backing member) and a layer of polyethylene terephthalate (50–90)/polyethyleneisophthalate (50–10)/copolymer (which serves as a heat-sealable adhesive).

The backing 25 of the exterior sheet material may be a flexible film selected from the group consisting of polycarbonate, polytetramethylene terephthalate, (e.g., using "Valox 303" resin from General Electric Corporation), polyamide derived from 6.6 nylon (e.g., using "Zytel ST 810HS" resin from E. I. duPont deNemours Co.), physical blends of polytetramethylene terephthalate/polyethylene, physical blends of polytetramethylene terephthalate/phenoxy, glycol modified polyethylene terephthalate (e.g. using "Kodar 6763" resin from Eastman Chemical Products, Inc.), polyvinylchloride, polypropylene and films derived from a graft copolymer comprising acrylonitrile/methylmethacrylate copolymer grafted onto an acrylonitrile/butadiene copolymer backbone (e.g. using "Barex" resin from Vistron Corporation). Other materials may include thin foil-film composites as described in U.S. patent application Ser. No. 264,657 assigned to the assignee of this application and have a thickness of between 50 micrometers to about 180 micrometers. A preferred material is a polycarbonate film backing (e.g. using "Merlon 700" resin from Mobay Corporation of Pittsburgh, Pa.) of about 130 micrometers in thickness.

The blank metal from which the can ends are formed might be coated with a different lacquer or enamel than the specific epoxy/phenolic resin or vinyl coatings mentioned above. An example of a different exterior enamel coating is an epoxy/urea formaldehyde clear coat such as Mobil S-6265-034 (available from Mobil Chemical Company) which may be applied at a film weight of 13 to 14 milligrams per 25.8 square cm (4 square inches) or 0.5 to 0.54 mg/cm$^2$ and baked for 10 minutes at 204° C. (400° F.) onto the can end. The important aspect is that the bonding strength of the second layer to the first layer must be high but not exceed the bonding strength between the film backing 25 and its adhesive layer 26 or exceed the bond between the adhesive layer 26 and the exterior second layer 20 such that the peeling of the tape from the can end causes a delamination of the top layer 20 and the first layer 19 to permit removal of the exterior tape.

Figure 6:
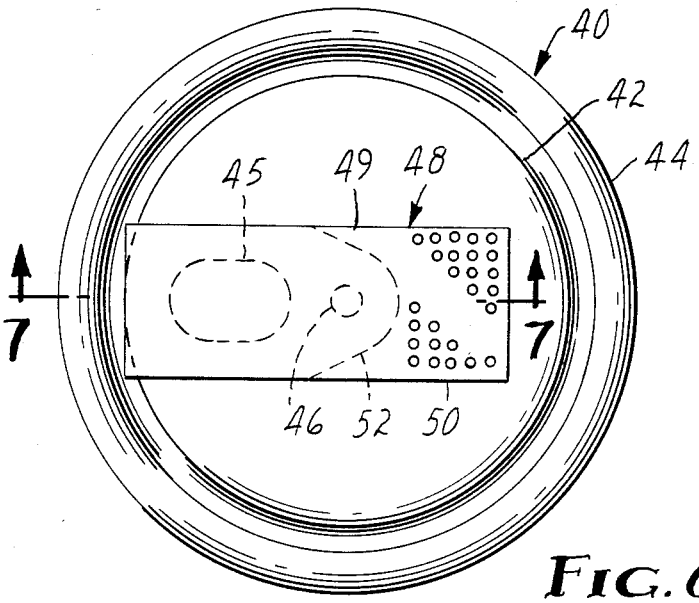
FIG. 6 is a plan view of a further embodiment of the tape closure of the present invention.
Figure 7:
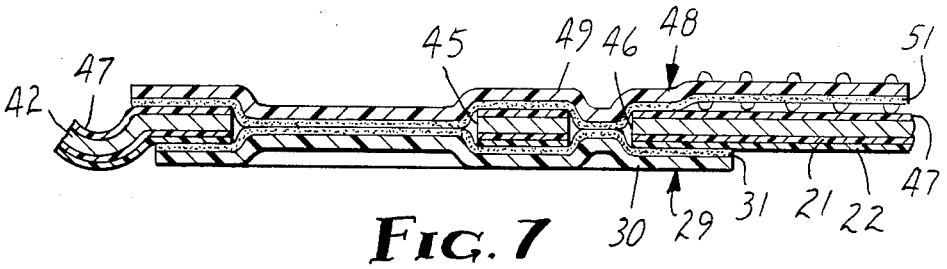
FIG. 7 is a vertical sectional view taken along the line 7—7 of FIG. 6.

Referring now to FIGS. 6 and 7, there is illustrated a further embodiment of a container end assembly, generally designated by the reference numeral 40. The container end assembly 40 comprises a container end or can end 42 formed of a metallic sheet material having a circular flange 44 and a pour opening 45 and a vent opening 46.

The can end 42 is formed of electro-tin plate steel (ETP) or tin-free steel (TFS) and is provided with an exterior protective layer 47. The coating for use on the ETP can end is a epoxy/urea formaldehyde as designated by coating S-6265-034 of Mobil Chemical Company coated at 3.6 milligrams per 6.45 square cm (square inch) or 0.55 milligrams per cm squared and baked 10 minutes at 204° C. (400° F.).

An example of the layer 47 for the tin-free steel end 42 is an enamel layer identified as S-1325-016 available from Mobil Chemical Company, of Pittsburg, Pa. which is a vinyl chloride/vinyl acetate copolymer, which is coated at 2.5 milligrams per 6.45 square cm (square inch) or 0.39 milligrams per centimeter squared and baked 10 minutes at 179.4° C. (355° F.).

An exterior tape 48 is adhered to the exterior layer 47, and comprises a backing 49 bonded circumjacent and completely covering the pour opening 45 and vent opening 46. A free end 50 of the tape 48 affords a tab for grasping to remove the tape. The adhesive bond made between a thermoplastic adhesive 51 coated on the tape backing 49 and the layer 47, is patterned to cover the area of the tape surrounding the pour opening 45 and the vent opening 46 and the bond terminates along converging edges illustrated at 52 adjacent to the tab 50. This pattern is such that the peeling force applied to the tape 48 is concentrated initially on a small area where the edges 52 converge to afford the initial fracture of the layer 47. After fracturing the layer 47 the tape is removed from the can end 42 by continually rupturing the bond between layer 47 and the can end 42 since the adhesive bond between the tape and the layer 47 has greater peel strength than the bond between the layer 47 and the can end and the layer 47 has greater integrity than the bond between the layer 47 and the surface immediately beneath the layer 47.

Figure 8:
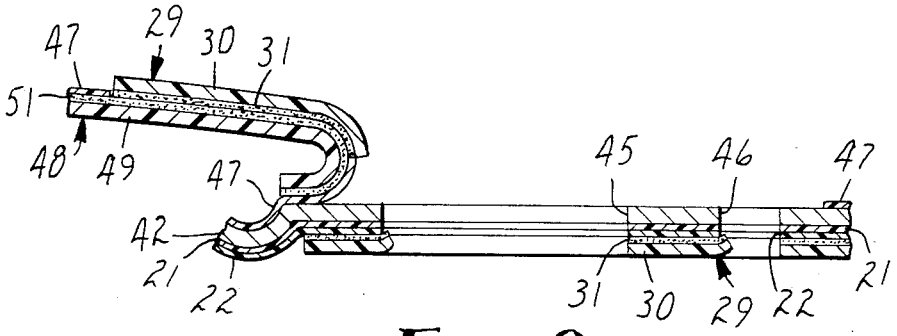
FIG. 8 is a second vertical sectional view showing the closure during removal of the tape.

In the embodiment of FIGS. 6, 7 and 8 an interior tape 29 is used to protect the exposed can edges at the openings 45 and 46 and is similar to the sheet material described above. The interior surface of the can end 42 is coated with coatings 21 and 22 to protect the can end and the tape backing 30 is adhered to the layer 22 by adhesive 31. As described above, when removing the tape 48 the interior tape 29 will be torn in the area of the vent opening 46 and the pour opening 45 where the interior tape 29 is adhered to the exterior tape 48.

Having thus disclosed the present invention with reference to the preferred embodiment which is illustrated in the drawing it is to be understood that a single layer of exterior tape may be applied to a can end over the pour opening 15 when the beverage is not carbonated or under pressure and will provide a suitable seal which is readily removable by peeling the exterior tape as hereinabove described. The exterior tape in a single tape system may thus be detachable from the can end upon opening the closure system.

I claim:

1. A container end assembly comprising:

a container end formed of tin-free steel having an exterior surface and an interior surface and being formed with a pour opening;

a polymeric layer comprised of a vinyl chloride/vinyl acetate copolymer bonded to said exterior surface of said end; and a tape strip comprising a backing coated on one surface with a thermoplastic adhesive and bonded by said adhesive to an area of the exterior surface of said layer circumjacent and covering said pour opening, said adhesive forming a bond between said tape strip and said layer having greater strength than the bond between said layer and the exterior surface of said tin-free steel end supporting said layer, causing said layer to break and peel from said end upon removal of the tape strip from the container end.

2. A container end assembly according to claim 1 wherein said tape strip backing comprises a flexible film selected from the group consisting of polycarbonate, polytetramethylene terephthalate, polyamide derived from 6-6 nylon, physical blends of polytetramethylene terephthalate/polyethylene, physical blends of polytetramethylene terephthalate/phenoxy, glycol modified polyethylene terephthalate, polyvinylchloride, polypropylene, and films derived from a graft copolymer comprising acrylonitrile/methylmethacrylate copolymer grafted onto an acrylonitrile/butadiene copolymer backbone, or thin foil-film composites.

3. A container end assembly according to claim 1 wherein said adhesive is a thermoplastic polyurethane.

4. A container end assembly according to claim 2 wherein said adhesive is a thermoplastic polyurethane.

5. A container end assembly according to claim 1 wherein said adhesive forming a bond between said tape strip and said polymeric layer forms a bond which is stronger in shear and tension than the bond between said layer and said surface supporting said layer and said layer is stronger than said bond between said layer and said surface supporting said layer whereby upon peeling of the tape strip from said container end said layer breaks and delaminates from the end in the area of the adhesive bond to said layer, peeling said layer in said area from said end upon removal of the tape strip from the container end, and a second interior tape is bonded to at least one protective layer on said interior surface of said end and to said adhesive through said pour opening.

6. A container end assembly according to claim 1 wherein said backing is polycarbonate.

7. A container end assembly according to claim 1 wherein said backing comprises a polycarbonate resin and said thermoplastic adhesive comprises polyurethane.

* * * * *